US005839936A

United States Patent [19]

Lin

[11] Patent Number: 5,839,936

[45] Date of Patent: Nov. 24, 1998

[54] PRESSURE-ACTUATED BUBBLE BLOWING TOY

[76] Inventor: Mo-Hsin Lin, 5th Fl., No. 4, Lane 7, Pao Kao Road, Hsintien, Taipei Hsien, Taiwan

[21] Appl. No.: 908,274

[22] Filed: Aug. 7, 1997

[51] Int. Cl.[6] ..... A63H 33/28

[52] U.S. Cl. ..... 446/16

[58] Field of Search ..... 446/15–18

[56] References Cited

U.S. PATENT DOCUMENTS

| | | | |
|---|---|---|---|
| 2,631,404 | 3/1953 | Clausen | 446/16 |
| 3,579,898 | 5/1971 | Hein | 446/16 |
| 3,736,694 | 6/1973 | Lebensfeld | 446/16 |
| 4,654,017 | 3/1987 | Stein | 446/15 |
| 5,183,428 | 2/1993 | Lin | 446/15 |
| 5,653,620 | 8/1997 | Lin | 446/15 |

FOREIGN PATENT DOCUMENTS

| | | | |
|---|---|---|---|
| 620504 | 5/1961 | Canada | 446/15 |

*Primary Examiner*—Robert A. Hafer
*Assistant Examiner*—Laura Fossum
*Attorney, Agent, or Firm*—Bacon & Thomas

[57] ABSTRACT

An improved pressure-actuated bubble blowing toy comprising a container and an insert therein, in which the insert is composed of an cylinder, a piston, and a film forming ring connected to the upper end of the piston, and characterized by the design of the piston with a base plate having a cut portion and a plurality of raised portions on its upper surface, and the cylinder have a rail on the inner wall of its lower portion so that by aligning the cut portion of the piston with the rail, the rising and lowering of the piston can be maintained in a fixed direction without unwanted rotation, and the raised portions provide passages for liquid to enter the upper portion of the cylinder to form film on the film forming ring where the base plate is contacted with the a stop ring between the upper and lower cylinder portions of the cylinder. The film forming ring is an elastic diamond body with contractible width while its length can be extended correspondingly so that it can be contracted for inserting into the upper cylinder portion and its width can be expanded while it is extended out of the cylinder for forming of larger bubbles.

2 Claims, 7 Drawing Sheets

PRESSURE-ACTUATED BUBBLE BLOWING TOY

BACKGROUND OF THE INVENTION

The present invention is related to an improved pressure-actuated bubble blowing toy, particularly an improvement to eliminate the defects of the prior art using a pipe to feed liquid and a film forming ring-the turning direction of the film forming ring can't be ascertained after it is elevated, and it is difficult to blow out large bubble because the film forming ring is restricted by a liquid outlet.

FIG. 1 shows a pressure-actuated bubble blowing toy according to the U.S. Pat. No. 3,736,694 (Appl. No. 248,049). In which an insert 2' is mounted within a container 1', the insert 2' comprises a cylinder 21', a piston 22', and film forming ring 23', and a pipe 24'. The container 1' has a top opening 11' covered with a threaded cap 12'. The cylinder 21' is divided to an upper cylinder portion 211', and lower cylinder portion 212' and a stop ring 213'. The piston 22' has a base plate 221' for displacement vertically within the lower cylinder portion 212' by hydraulic pressure. The film forming ring 23' is connected to the upper end of the piston 22' by means of a connecting rod 231'. The pipe 24" has its upper end connected to the upper cylinder portion 211' so that a liquid 3 can enter the upper cylinder portion 211' via the pipe 24' for the film forming ring 23' to form film.

With such a structure, squeezing of the container 1' does not only rise the piston 22' and the film forming ring 23', but increases the flow of the liquid into the upper cylinder portion 211', and even results in overflow. Moreover, the larger the top opening 11', the greater the restriction to the design for shape of the container. For instance, when the top is designed with a shape of a coke or wine bottle, the greater the top opening 11', the less the fidelity of the shape of the coke or wine bottle. Therefore, in general small top opening 11' is used to minimize overflow and adverse effect to its shape design. Then, the film forming ring 23' must be relative small, but in such case it can form small bubbles only, the fun of bubble blowing is thus affected.

Moreover, when the base plate 221' gets contact with the stop ring 213' the upward flow of the bubble is blocked. Then an extra pipe 24' must be installed. However, such a structure can be simplified. Furthermore, while the piston 22' and the film forming ring 23' are rising, they may turn to unwanted direction so that the container may needs to be rotated after the film forming ring 23' is extended out to make the film forming ring 23' facing the direction of blowing. It is not convenient to do so.

SUMMARY OF THE INVENTION

The main objective of the present invention is to eliminate the defects of the prior art, simplify its structure and improve its effect.

The present invention provides a diamond film forming ring with contractible width while its length can be extended correspondingly so that the top opening of the container can be relatively small but large bubbles can be formed.

The present invention provide a direct channel for supply of liquid in the cylinder to simplify the pipe structure and lower production cost.

Moreover, the present invention provide a positioning device for the film forming ring to main it in the same direction while it is extended out of the cylinder.

DETAILED DESCRIPTION OF THE PREFERRED EMBODIMENT

An embodiment of the present invention is described below with reference to the attached drawings.

Figure 1:
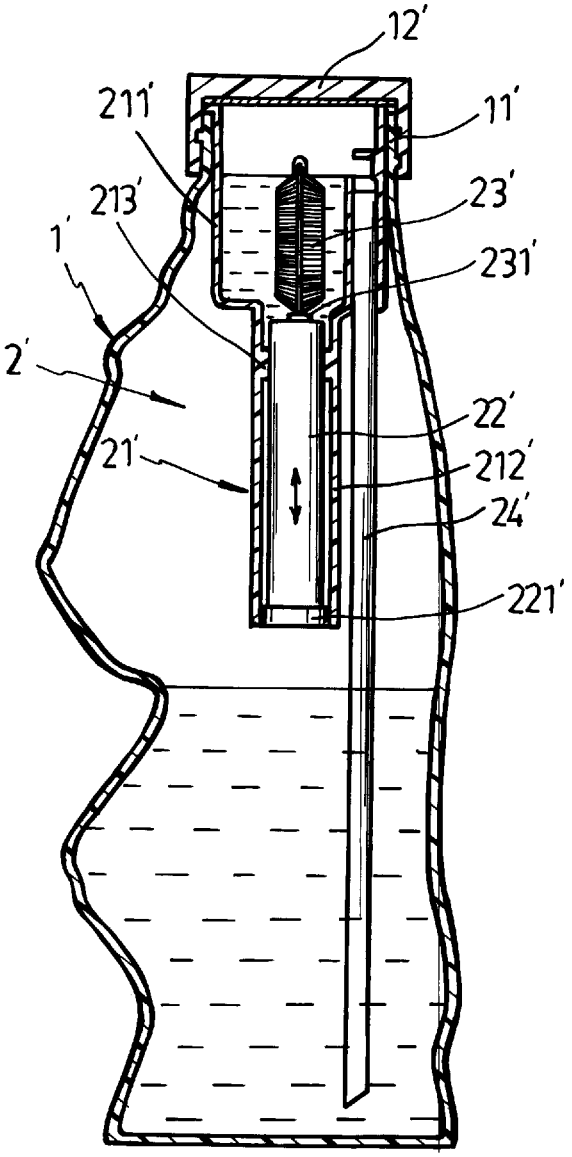
FIG. 1 PRIOR ART
FIG. 1 is a sectional view of a conventional pressure-actuated bubble blowing toy.
Figure 2:
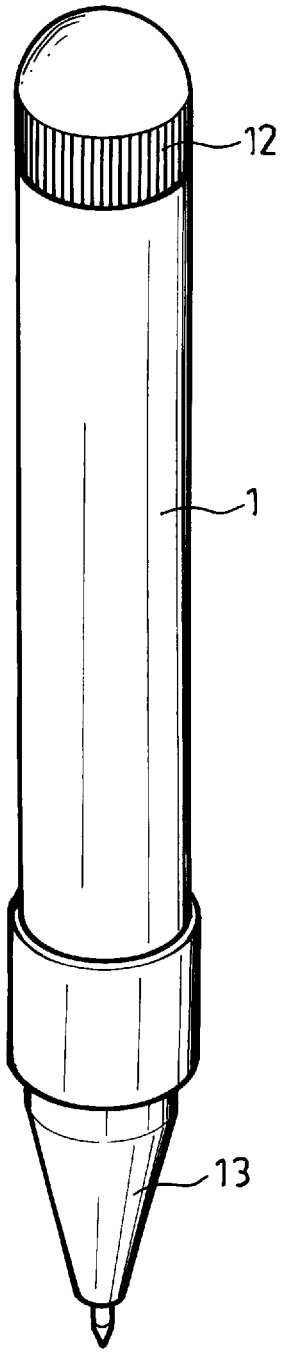
FIG. 2 is a perspective view of an embodiment of the present invention.
Figure 3:
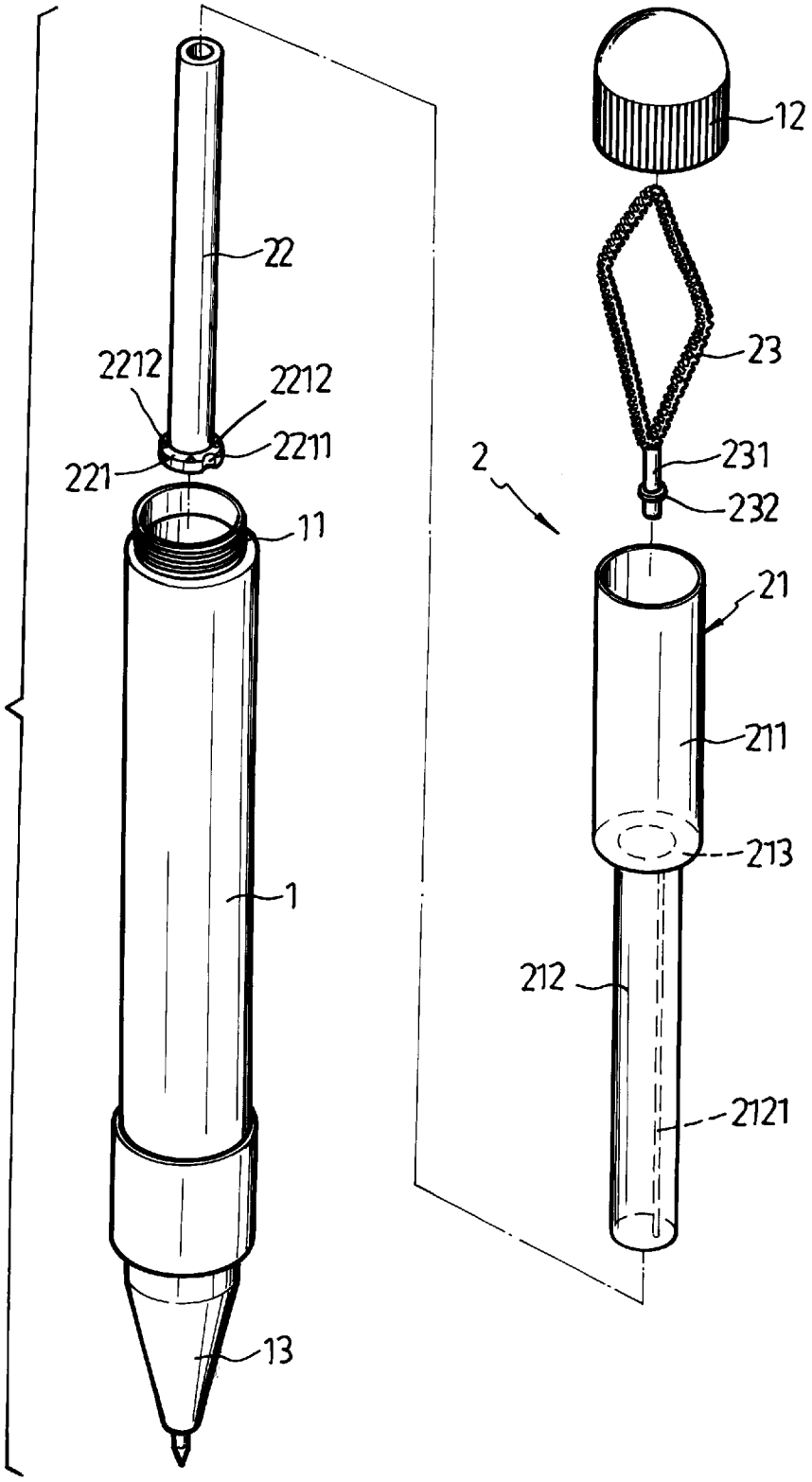
FIG. 3 is a perspective fragmented view of the embodiment of the present invention.
Figure 4:
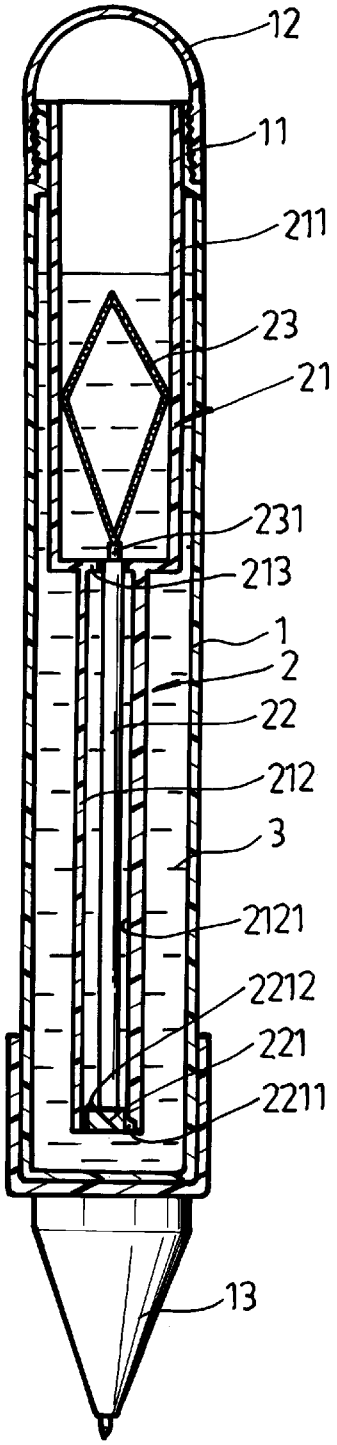
FIG. 4 is a sectional view of the embodiment of the present invention.

Please refer to FIGS. 2, 3 and 4, the pressure-actuated bubble blowing toy according to the present invention comprises mainly a container 1 and an insert 2 mounted within it. The insert 1 is composed of a cylinder 21, a piston 22, and a film forming ring 23. The film forming ring 23 is elastic so that it can be contracted and expanded. Therefore, in the preferred embodiment shown by the drawings the pressure-actuated bubble blowing toy can be designed to a shape of a pen. That is, it can be designed with a small top opening 11 and a small cap 12, and with a writing instrument 13 at the bottom. Of course, the shape shown as the preferred embodiment is for reference only, it is intended to show that the smaller the top opening 11, the less the restriction to the shape of the pressure-actuated bubble blowing toy, and the greater the flexibility in design of the toy.

The said cylinder 21 can be divided into an upper cylinder portion 211, a lower cylinder portion 212, and a stop ring 213. The piston 22 is incorporated with a base plate 221, while the film forming ring 23 has a connecting rod 231 and a connection ring element 232. The connection ring element 232 is seized by a groove at the upper end of the piston 22, but it is not to be described in detail as its structure is same with that in the conventional pressure-actuated bubble blowing toy.

The improvement achieved by the present invention is on the design of the base plate 221 for the piston 22. The base plate 221 has a cut portion 2211, and is formed with a plurality of raised portions 2212 on the upper surface. The lower cylinder portion 212 is formed with a rail 2121 on its inner wall. The film forming ring 23, in the shape of a diamond, is elastic and contractible. While placing the piston 22 into the lower cylinder portion 212, the cut portion 2211 is aligned with the rail 2121 in the lower cylinder portion 212 so that the piston 22 and the film forming ring 23 are displaced vertically in the same direction without unwanted rotation while the toy is squeezed.

Figure 5:
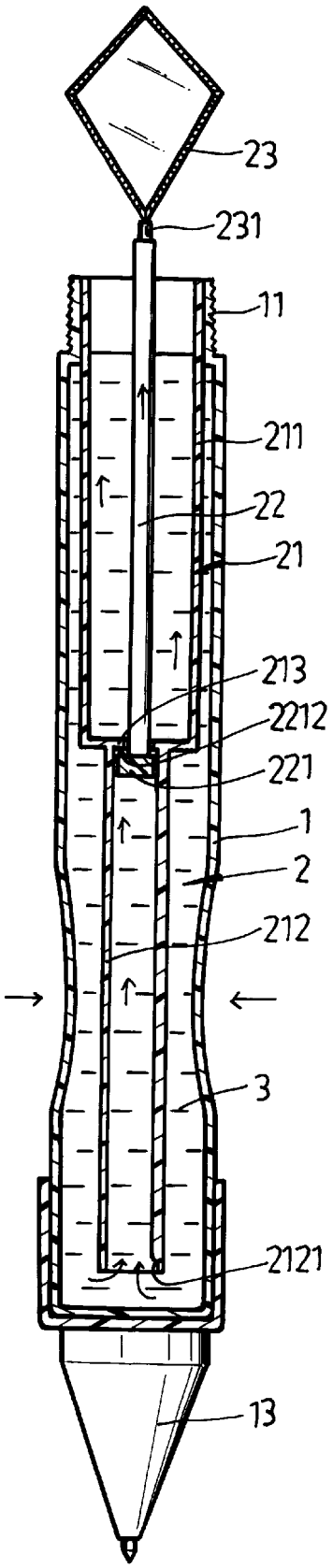
FIG. 5 is a sectional view illustrating the embodiment being squeezed (1)
Figure 6:
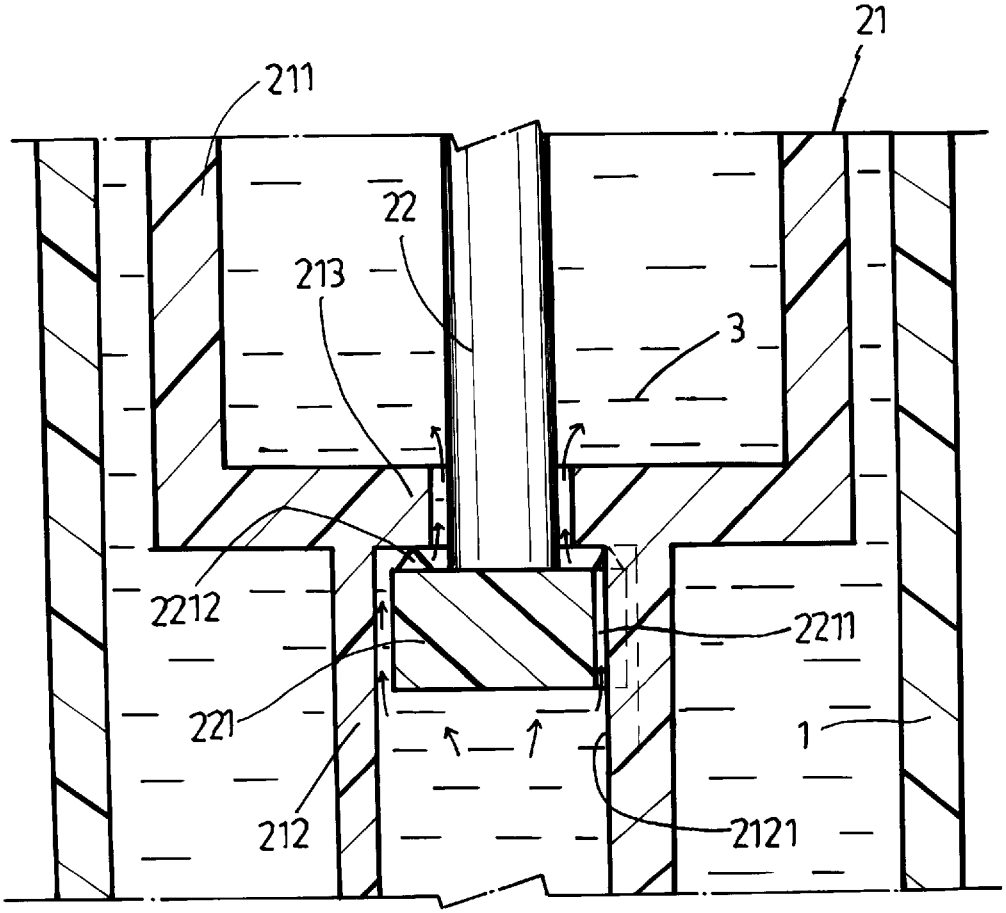
FIG. 6 is an enlarged sectional view of a part of the insert according to the present invention.
Figure 7:
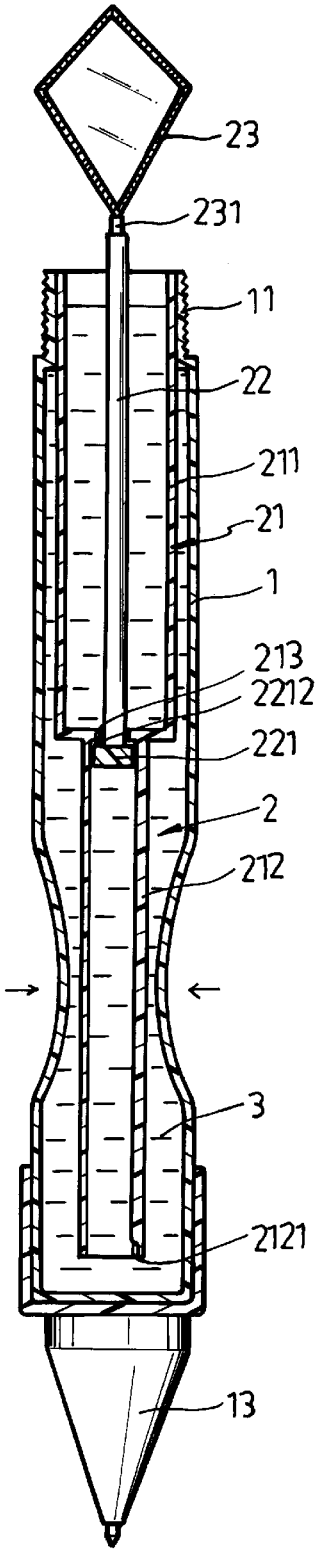
FIG. 7 is a sectional view illustrating the embodiment being squeezed (2)

Please refer to FIGS. 5, 6 and 7, when the container 1 is squeezed, the piston 22 and the film forming ring 23 raise upward because of the hydraulic pressure in the cylinder 1. Then the base plate 221 reaches the stop ring 213, there are passages for the liquid 3 between the base plate 221 and the stop ring 213 because of the raised portions 2212 on the base plate 221. Moreover, as the base plate 221 is not kept contact with the inner wall of the lower cylinder portion 212 tightly, the liquid 3 can flow freely in the gap between them, and goes into the upper cylinder portion 211 through the passages formed by the raised portions 2212 between the base plate 221 and the stop ring 213.

Figure 8:
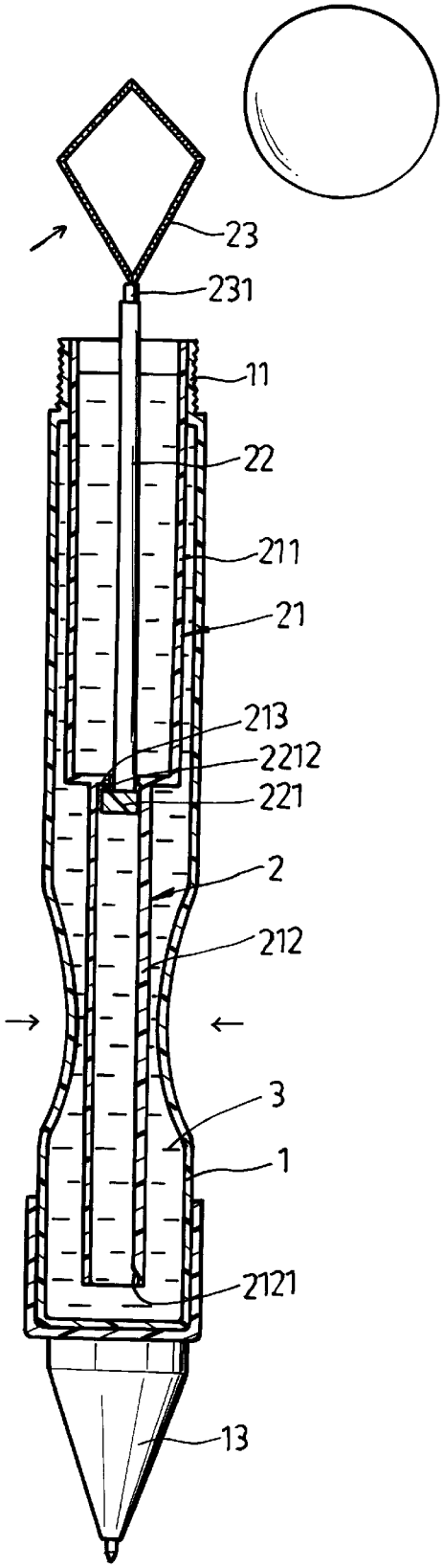
FIG. 8 is a sectional view illustrating forming of bubbles with the film forming ring shown in FIG. 6.

Please refer to FIGS. 7 and 8, the said film forming ring 23 can be expanded from the contracted status shown in FIG. 4 to its full width for forming of larger bubbles.

Figure 9:
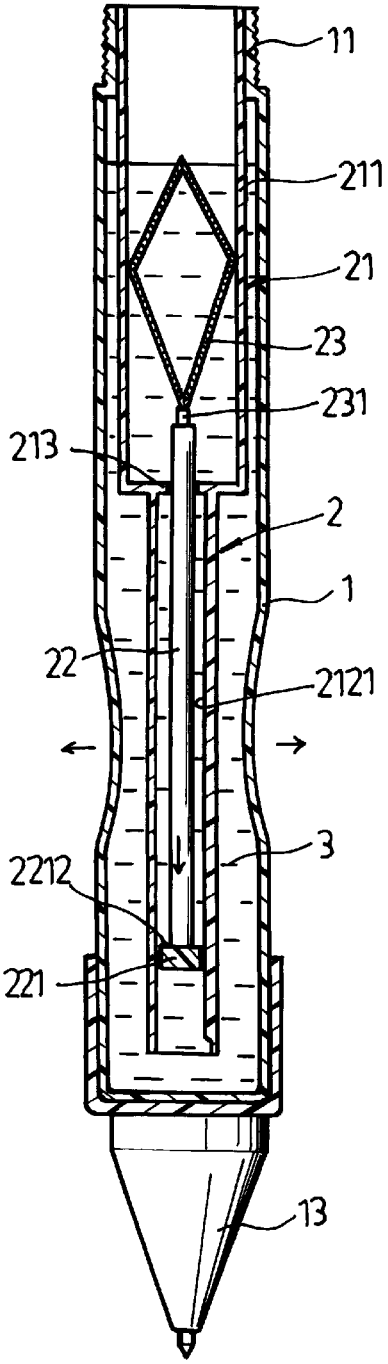
FIG. 9 is a sectional view illustrating reduction of pressure applied to squeeze the container.
Figure 10:
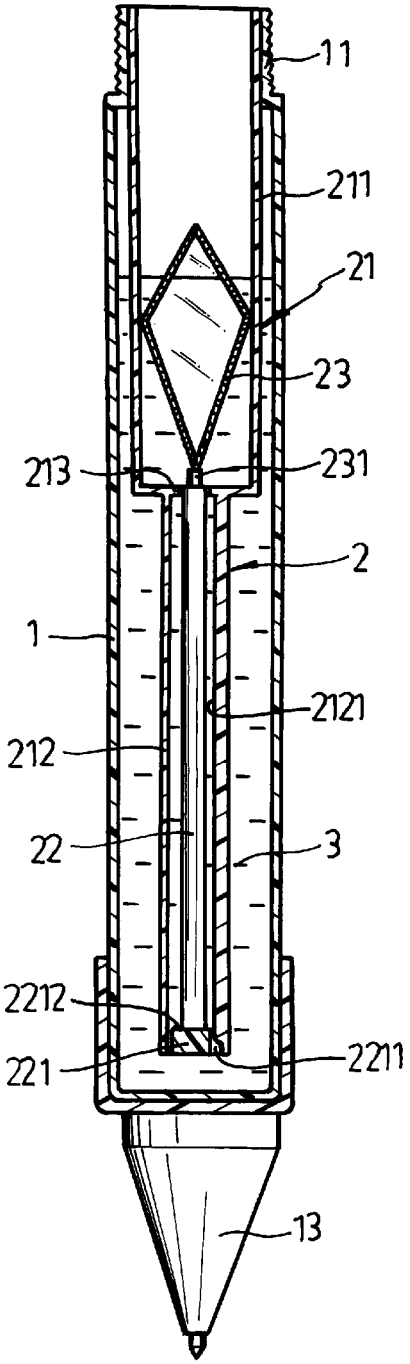
FIG. 10 is a sectional view illustrating the container which is not squeezed after blowing of bubbles.

Please refer to FIGS. 9 and 10, when the pressure applied to the container is slightly reduced, the piston 22 and the film forming ring 23 fall down because of the falling of hydraulic pressure. Then, as the film forming ring 23 is an elastic diamond body, the lower portion of the film forming ring 23, i.e., a "V" component allows reduction of its width but extension of its length so inserting into the upper cylinder portion 211, but the liquid 3 maintains a high level in the upper cylinder portion 211. Hence, the film on the film forming ring 23 is maintained for blowing during the next operation.

In conclusion, the present invention simplify the pipe structure of the conventional pressure-actuated bubble blowing toy, and cause the film forming ring to maintain in a certain direction while rising. It can also expand the width of the film forming ring for forming of larger bubbles. Therefore, there is an improvement in effect and it is progressive.

I claim:

1. An improved pressure-actuated bubble blowing toy, comprising:

a container; and an insert mounted within said container, said insert being formed by a cylinder having an upper portion, a lower portion and a stop ring therebetween, a piston which is movable between a lowered position and a raised position within said cylinder, said piston having an upper end and a lower end, and a film forming ring connected to said upper end of said piston;

wherein at said lower end of said piston has a base plate having a plurality of raised portions on an upper surface thereof, said raised portions providing passages when said base plate contacts said stop ring such that pressure used to actuate said piston forces liquid to enter said upper portion of said cylinder through said passage when said piston is in said raised position; and wherein said lower portion of said cylinder has a rail on an inner wall thereof and said base plate has a cut portion on a side thereof, said cut portion of said base plate of said piston being aligned with said rail so that said piston is movable between said lowered position and said raised position substantially without rotation of said piston.

2. The improved pressure-actuated bubble blowing toy according to claim 1, wherein said film forming ring is an elastic diamond body with contractible width and correspondingly extendable length such that its width is easily contracted for insertion into said upper cylinder portion and its width is expanded when it is extended out of said cylinder for forming larger bubbles.

* * * * *